US007984635B2

(12) United States Patent
Callebaut et al.

(10) Patent No.: US 7,984,635 B2
(45) Date of Patent: Jul. 26, 2011

(54) ASYMMETRIC INCREMENTAL SHEET FORMING SYSTEM

(75) Inventors: Bart Callebaut, Nieuwerkerken (BE); Joost Duflou, Leuven (BE); Johan Verbert, Schoten (BE)

(73) Assignee: K.U. Leuven Research & Development, Leuven (BE)

( * ) Notice: Subject to any disclaimer, the term of this patent is extended or adjusted under 35 U.S.C. 154(b) by 833 days.

(21) Appl. No.: 11/918,935

(22) PCT Filed: Apr. 21, 2006

(86) PCT No.: PCT/BE2006/000037

§ 371 (c)(1),
(2), (4) Date: Oct. 22, 2007

(87) PCT Pub. No.: WO2006/110962

PCT Pub. Date: Oct. 26, 2006

(65) Prior Publication Data

US 2009/0158805 A1 Jun. 25, 2009

(30) Foreign Application Priority Data

Apr. 22, 2005 (GB) ..... 0508156.7
Apr. 25, 2005 (GB) ..... 0508271.4

(51) Int. Cl.
*B21D 37/16* (2006.01)

(52) U.S. Cl. ..... 72/342.1

(58) Field of Classification Search ..... 72/342.1, 72/342.5, 343, 379.2, 342.2, 342.6, 342.94, 72/342.96

See application file for complete search history.

(56) References Cited

U.S. PATENT DOCUMENTS

| | | | | |
|---|---|---|---|---|
| 5,026,514 | A | 6/1991 | Hauwiller et al. | |
| 6,585,408 | B2 * | 7/2003 | El-Gabry et al. | 374/43 |
| 2001/0029768 | A1 | 10/2001 | Okada et al. | |
| 2004/0187545 | A1 | 9/2004 | Okada et al. | |
| 2004/0187548 | A1 | 9/2004 | Okada et al. | |

FOREIGN PATENT DOCUMENTS

| | | | |
|---|---|---|---|
| DE | 40 34 625 | A1 | 5/1992 |
| DE | 44 25 033 | A1 | 1/1996 |
| EP | 1 147 832 | A2 | 10/2001 |
| EP | 1 462 189 | A1 | 9/2004 |
| EP | 1 462 190 | A1 | 9/2004 |
| JP | 2003-236626 | | 8/2003 |

* cited by examiner

*Primary Examiner* — Teresa M Ekiert
(74) *Attorney, Agent, or Firm* — Bacon & Thomas, PLLC

(57) ABSTRACT

The present invention relates, in general, to sheet material forming technology and the forming of structures there from. The invention relates to incremental forming of sheet material (1) with localised heating (5) and more particularly to a system and method for incrementally forming a sheet blank (1) that is at the same time heated by a dynamically moving heating source (5). This dynamic and localised heating locally changes the mechanical properties of the sheet material (1), thus facilitating the forming process.

20 Claims, 5 Drawing Sheets

ASYMMETRIC INCREMENTAL SHEET FORMING SYSTEM

BACKGROUND OF THE INVENTION

A. Field of the Invention

The present invention relates, in general, to an improvement of the Asymmetric Incremental Sheet Forming (AISF) technology, and more particularly to an improved Asymmetric Incremental Sheet Forming (AISF) apparatus or method for easier and more accurately forming of sheet material of various composition. More particularly the invention is related to a system and method for asymmetric incrementally forming a sheet material blank by means of a locoregional heat/cooling system that is synchronised with the movement of the forming tool. The sheet material is at the same time locally heated at the contact zone of the forming means by a dynamically moving heating source that moves synchronically with the movement of the forming means over the surface of the sheet material to locally increase plasticity of the sheet material only at the contact zone of the forming tool or just in front or next to the contact zone of the forming tool on its movement toolpath.

B. Description of the Related Art

Incremental forming is the process of forming sheet material into complicated shapes without the use of either male or female dies. The method uses a single point means which plastically deforms sheet material, which is clamped in a blank holder to provide a localised deformation. The final shape of the part can for instance be obtained by the relative movement of a simple and small forming tool with respect to the blank. By incrementally moving the forming tool over the sheet using a controllable positioning system, for instance a computer numerically controlled tool, the plastically deformed points are, in effect, added as a means moves to provide a final shape.

Many different implementations of the incremental forming method exist. Single Point Incremental Forming uses a simple forming tool, preferably a hemispherical tool, to deform a sheet material clamped within a forming rig, and most preferably a metal rod with a smooth hemispherical tip, for instance within the range of 9-30 mm (FIG. 2). Two Point Incremental Forming also uses as forming tool a simple hemispherical tool to deform a sheet material clamped into a forming rig. The difference lies in the fact that under the sheet material a partial die is located and that the rig is allowed to translate along the bushings in the direction of the forming tool (FIG. 3). Other implementations exist as well where a hammering device or shot peening device replaces the forming tool. The forming tool can be controlled using a CNC milling machine, a robot or any other device that allows for the exact positioning of the forming tool.

The forming tool used is in many cases a simple hemispherical tool. There is no need for the forming tools to be adapted to the part to be formed. With a basic set of tools one is capable of forming a wide variety of desired part geometries.

This method of incremental forming, in the present state of the art, is suitable for incremental forming of soft materials such as aluminium and steels with a low carbon content 0.05% to 0.26% (e.g. AISI 1018 steel). The method, however, has the drawback that the forces on the forming means become high when forming thicker material or material with high yield strength and low ductility. For instance if the content of carbon rises in alloys of iron and carbon, the metal becomes harder and stronger but less ductile and it is more difficult to shape the alloy sheet with an asymmetric incremental sheet forming (AISF) apparatus.

Furthermore, it is generally not possible to substantially form harder and stronger but less ductile materials such as the alloys of iron and carbon for instance medium carbon steel: 0.29% to 0.54% (e.g. AISI 1040 steel), high carbon steel: 0.55% to 0.95%, very high carbon steel: 0.96% to 2.1% or the Titanium Grade 5 or Magnesium sheet materials. Yet another drawback is the difficulty to create clearly localised slope changes within parts. Should this slope change be located near the edge of the part this problem could be solved by using backing plates. This backing plate supports the region of the sheet material blank that should not be plastically deformed (see FIG. 2). These backing plates are cumbersome to work with and very difficult to use when the sudden slope change is not located near the edge of the plate.

Thus, there is a need in the art for improving the methods of incremental forming. The present invention provides an improvement to these drawbacks by using a method to incrementally form a sheet material blank that is at the same time locally heated by a dynamically moving heat source.

SUMMARY OF THE INVENTION

The present invention solves the problems of the related art of incremental forming by providing a means to incrementally form a sheet material blank with lower forces and with less unwanted plastic deformation along non-supported contours. The invention also allows to improve the formability of materials characterised by limited strainability at room temperature.

The invention concerns an asymmetric incremental sheet forming (AISF) apparatus comprising at least one clamping system (2) for holding a sheet material (1) and at least one forming tool (3) whereby the forming tool (3) and the sheet material are movable relatively towards each others in three dimensions to plastically deform contact points on to the sheet material (1) along defined toolpath corresponding to a defined three dimensional shape of the sheet material (1) to be formed and whereby the AISF apparatus is characterised by the inclusion of at least one heating means (4) arranged to locoregionally provide a heat flux (5) to the sheet material (1) and to increase the plasticity of the sheet material (1) along the contact toolpath of the forming tool (3).

The heating means (4) in this apparatus is located to provide a heat flux (5) that dynamically follows the moving contact zone of the toolpath of the forming tool (3) on the sheet material (1). Furthermore the heating means (4) can be arranged to locoregionally provide a heat flux (5) to the sheet material (1) and to increase the plasticity of the sheet material (1) on the tool path of the forming tool (3) at the contact zone of the forming tool (3) or slightly offset to the contact zone of the forming tool (3).

In a particular embodiment the heating means (4) is arranged to locoregionally provide a heat flux (5) to the sheet material (1) and to increase the plasticity of the sheet material (1) on the toolpath of the forming tool (3) with a lateral offset to the contact zone of the forming tool (3).

But alternatively the heating means (4) is arranged to locoregionally provide a heat flux (5) to the sheet material (1) and to increase the plasticity of the sheet material (1) on the toolpath of the forming tool (3) with a forward offset to the contact zone of the forming tool (3). A particular advantage of such apparatus is that it can be used to shape sheet materials in the desired forms with less formation of material strains and thus without the need of a separate annealing step.

Furthermore the asymmetric incremental sheet forming (AISF) apparatus of present invention can comprise at least one cooling means (6) to cool a zone of sheet material (1) adjacent to the contact zone of the forming tools (3) or adjacent to the heating zone on the toolpath. Such cooling means (6) can provide a cold flux that dynamically follows the moving heating zone or the contact zone on the sheet material (1) along the toolpath of the forming tool (3).

In a particular embodiment of present invention the heating means (4) is positioned to heat the sheet material (1) at the side of the contact zone of the forming tool (3) on the sheet material (1). The cooling means (6) can be positioned to provide a cold flux (5) at the opposite side of the sheet material (1) than the side of the contact zone of the forming tool (3).

Alternatively the cooling means is positioned to cool the sheet material (1) at the side of the contact zone of the forming tool (3) on the sheet material (1) and the heating means (4) is positioned to provide a heat flux (5) at the opposite side on the sheet material (1) than the side of the contact zone of the forming tool (3).

In a particular embodiment of present invention the clamping system (2) of the asymmetric incremental sheet forming (AISF) apparatus is movable in three dimensions to move the sheet material (1) according to defined coordinates. Hereby the heating means (4) can be fixed and positioned to provide the heat flux to the contact zone of the forming tool (3) and the clamping system can be movable in three dimensions to move the sheet material between the heating means and the forming tool (3). But in an alternative embodiment the clamping system (2) is fixed and the forming tool (3) and the heating means (4) are movable in three dimensions according to defined coordinates.

Such fixed sheet material (1) system can comprise at least one heating means for heating the sheet material (1), a control means for controlling the intensity of the heat flux (5) from the movable heating means to the sheet material (1) to be formed, a control means for controlling the movement of the forming tool over its toolpath on the surface of said sheet material (1) and a control means for controlling the movement of the heating means (4) or for positioning its heat flux (5) on the sheet material and further comprising a synchronisation means (8) for synchronising the movement of the heating means or its heat flux and the forming tool on the toolpath to achieve if operational a locoregionally increase of the plasticity of the sheet material (1) at the contact zone of the forming tool or slightly offset to this contact zone.

Furthermore such apparatus can comprise at least one pyrometer or another temperature measuring device over the sheet material (1), for measuring the temperature at the zone of heating sheet material (1). Such pyrometer can be connected to a control means that controls the heat flux (5) from heating means (4) to the sheet material within a control temperature range having a lower limit defined as a temperature that does exceed a lowest temperature to locoregionally increase plasticity or lower the yield strength depending on constituent components of the material of the sheet to be formed, and an upper limit defined as a temperature that does not exceed a heat decomposition initiation temperature or the melt point temperature.

Such apparatus can further comprise at least one cooling means (6) to cool a zone of sheet material (1) adjacent to the contact zones of the forming tools (3) and such cooling means (6) can be positioned to cool a zone of sheet material (1) surrounding the heated zone on the sheet material (1).

In a specific embodiment of the fixed sheet material apparatus of present invention the control means controls the movement of the forming tool (3) over its toolpaths on the surface of said sheet material (1) and the synchronisation means for controlling the movement of the heating means (4) or for positioning its heat flux (5) on the material sheet are integrated in the synchronisation controller (8) to synchronise the toolpath of the forming tool with the toolpaths of the heat flux (5) of the heating means (4).

The movement of the forming tool (3) and the dynamically moving heat flux (5) from the heating means (1) can for instance be synchronised by a computer control system. Such computer control system can be a computer numerically controlled (CNC) means to obtain a specific geometry of a specific sheet of material by varying the parameters of the task based upon the specific characteristics of the sheet material, on the capabilities of the forming tool (3), on the heat flux (5) provided by the heating means (4), on the cold flux provided by the cooling means (6) and/or on the required or desired performance criteria for the resulting formed sheet. The characteristics can comprise parameters selected of the group of type of material of the sheet material, the thickness of the sheet material, performance criteria of the formed sheet and the effect on the cost of the resulting formed sheet.

In a specific embodiment of present invention the asymmetric incremental sheet forming apparatus is a single point incremental forming apparatus or a two point incremental forming apparatus.

In yet another specific embodiment the asymmetric incremental sheet forming apparatus of present invention comprises a lubrication means to apply a lubricant to or to make slippery or smooth the contact zone on the sheet material of the forming tool or it comprises a lubricating means to apply a lubricant at the outer impact end of the forming tool.

The forming tool (3) used in the apparatus can be a mechanical tool in various forms. For instance the forming tool (3) can be a type selected of the group consisting of a stylus, a punch, a hammer and a rod.

Forming tools (3) of various forms are suitable. For instance the forming tool (3) may have a smooth hemispherical, concave or convex outer impact end. Moreover various materials are suitable for the forming tools (3) for instance the forming tool (3) can be composed of cast steel, glass or ceramic and it can be coated with a cemented carbide coating or a high temperature resistant, friction resistant coating such as a TiN, CrN or DLC (diamond like carbon) coating.

Various sizes of mechanical forming tool are suitable depending on the dimensions of the workpiece to be formed. For instance the forming tool (3) can have a diameter between 5 and 100 mm, more preferably between 6 and 50 mm and most preferably between 8 and 15 mm.

Furthermore various heating means (4) are available to provide a heat flux on the sheet material. For instance the heating means can be a visible light and/or infrared light heater. It can be a laser, a torch or an induction current heater.

A particular embodiment of present invention is a method of asymmetric incremental sheet forming (AISF) whereby a forming tool (3) is programmed to move along a defined toolpath on a sheet material (1) to plastically deform a contact zone along that path (1) corresponding to a defined three dimensional shape of the sheet material (1) to be formed and the method characterised in that a dynamically moving heating means (4) synchronically provides a heat flux (5) to the toolpath of said forming tool (3) to create a locoregional plastic region at or slightly offset to the contact zone of the forming tool (3) on the sheet material (1) to be formed, while keeping the sheet material (1) part adjacent to the heated zone under an unheated or cooled condition. The heat flux (5) hereby moves in a synchronised manner with the forming tool (3) along a toolpath over the material sheet. Furthermore a cold flux can be provided to locoregionally cool the sheet metal part surrounding the locoregional heated zone. Such cold flux moves preferably in a synchronised manner with the forming tool (3) along a toolpath over the material sheet.

The apparatus and the method employed by the apparatus of present invention are suitable for rapid prototyping of parts made in a sheet material (1) that are difficult to be shaped in a desired form by the incremental forming apparatus of the state of the art. For instance the apparatus of present invention can be used to incrementally form thick sheet materials, sheet materials of high yield strength at room temperature or materials that are less workable at room temperature and sheet materials composed of ultra-fine grain sizes or "nanostructured" polycrystalline metallic materials, in particular of nanostructured titanium metals and alloys. Shell like articles of nanostructured titanium metals or alloys are obtainable by the asymmetric incremental sheet forming method of present invention.

The apparatus of present invention is also particularly suitable to incrementally form sheet materials selected of the group consisting of brass, iron, platinum, HS steel, dual phase steel, amalgams, stainless steel, Ti alloys, Magnesium Alloys and TRIP steel.

A surprising finding is that the apparatus of present invention is suitable for rapid prototyping of thermoplastic material, in particular the thermoplastic materials selected of the group consisting of polystyrene, polyethylene, polypropylene and polycarbonate. Shell like articles of thermoplastic material are obtainable by the asymmetric incremental sheet forming method of present invention.

DETAILED DESCRIPTION OF EMBODIMENTS OF THE INVENTION

The following detailed description of the invention refers to the accompanying drawings. The same reference numbers in different drawings identify the same or similar elements. Also, the following detailed description does not limit the invention. Instead, the scope of the invention is defined by the appended claims and equivalents thereof.

Referring now specifically to the drawings, an apparatus and method according to an embodiment of the invention is illustrated in FIG. 1. The system has particular application in forming sheet material, for example metal sheets.

Asymmetric Incremental Sheet Forming (AISF) for the meaning of this invention is a sheet metal forming process that uses a solid, small-sized forming tool, does not use large, dedicated dies and whereby the forming tool is in continuous or repetitive contact with the sheet metal. The tool moves in a controllable manner in a three dimensional volume and can produce symmetric as well as asymmetric sheet metal shapes. This AISF is particularly suitable for rapid prototyping. The movement of the forming tool in relation to the blank (sheet material) is obtainable by moving the forming tool in a controllable manner or by moving the blank in a controllable manner whereby the forming tool can be in a fixed position or can remain movable, for instance rotatable on its axis or make translateral movements but from an initial defined position to another defined position, which is preferably the contact zone on the sheet material.

An asymmetrical sheet forming system has generally four basic elements such as the sheet material blank, a blank holder, at least one single point forming tool and a motion control system that defines the relative motion of the forming tool to the sheet material. This control system can be a CNC controller or other controller systems. There currently exist two types of AISF, the two point Incremental Forming (TPIF) (Powell and Andrew IMEchE part B, J. of Engineering Manufacture, 1992, vol. 206, pp 41-47 and Matsubara S. Incremental Backward Bulge Forming of a Sheet Metal with a Hemispherical Tool J. of the JSTP, vol. 35, pp 1311-1316, 1994) and the single point incremental forming (SPIF) (Jeswiet Proceedings of Shemet, April 2001, pp 165-170 and Leach $9^{th}$ Conference on Sheet Metal Leuven, pp 211-218, 2001). The TPIF differentiates from the SPIF in that it has two instead of one zones where the sheet metal is formed.

"Locoregional" means limited to a local region and "Local" for the present invention refers to an action taking place on a sheet material to be formed at a position of mechanical deformation by the forming tool or the direct environment thereof (zone of deformation). Such zone is heated in a precision manner by a heat flux creating a heated zone on the surface of the sheet material that is only a few times the diameter of the contact zone of the forming tool, preferably less than twice the diameter of the contact zone of the forming tool and more preferably about the diameter of the contact zone of the forming tool.

"Thick sheet materials" for present invention is a sheet material with a thickness higher than the following thicknesses:

AA1050-O: 1.21 mm; AA6114-T4: 1.0 mm; Al 3003-O: 2.1 mm; Al 5754-O: 1.02 mm; Al 5182: 0.93 mm; AA 6111-T4P: 0.93 mm; DC04: 1.0 mm; DDQ: 1.0 mm; HSS: 1.0 mm; Copper: 1.0 mm; Brass: 1.0 mm;

"High yield strength" for the present invention is a yield strength higher than 450 $N/mm^2$. "Vicinity" in the meaning of this invention refers to a surrounding, or adjacent region around the contact zone of the forming tool (formation zone). Such can be on a distance of approximately a few times the tool diameter.

It will be apparent to those skilled in the art that various modifications and variations can be made in the incremental forming process or apparatus of the present invention and in construction of the system and method without departing from the scope or spirit of the invention. Examples of such modifications are provided in this file.

Other embodiments of the invention will be-apparent to those skilled in the art from consideration of the specification and practice of the invention disclosed herein. It is intended that the specification and examples be considered as exemplary only, with a true scope and spirit of the invention being indicated by the following claims.

DRAWING DESCRIPTION

Brief Description of the Drawings

The present invention will become more fully understood from the detailed description given herein below and the accompanying drawings which are given by way of illustration only, and thus are not limitative of the present invention, and wherein.

The said process can be performed in an enclosed housing 7.

8 stands for a synchronised control of the toolpaths of both the forming and the heating means.

EXAMPLES

Example 1

Figure 4:
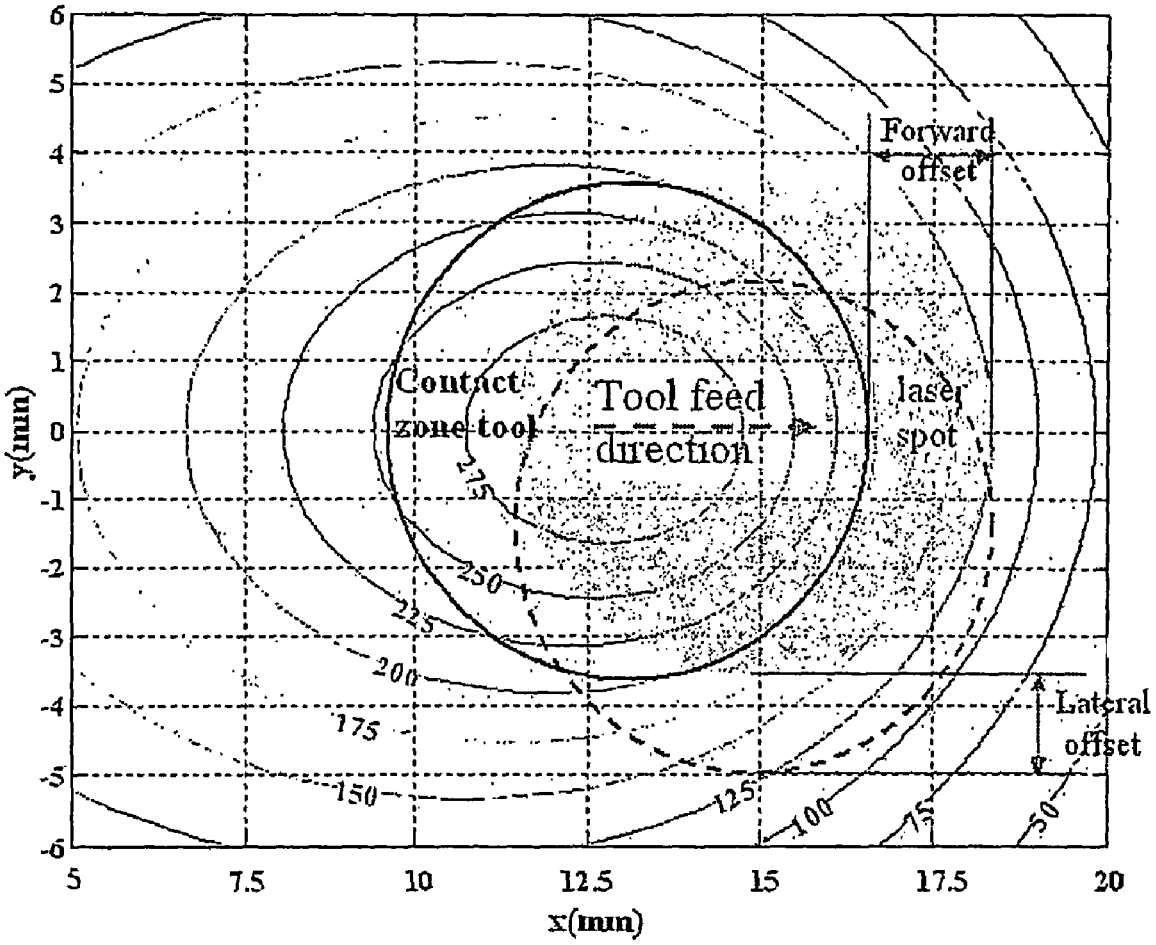
Figure 5:
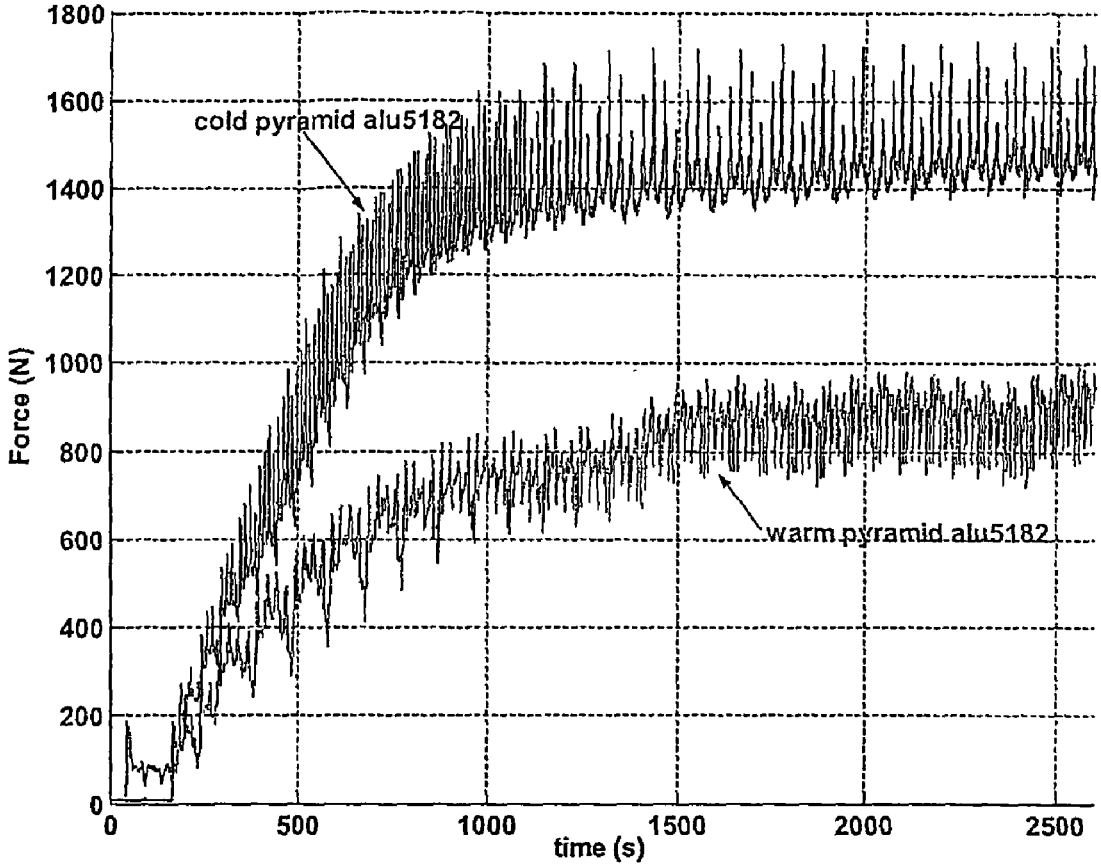

A sheet metal blank 1 of aluminium alloy EN 5182 ('Innerlite') of 1.15 mm thickness and a single point incremental forming means 3 of 10 mm diameter made out of tungsten carbide ('grade Cki10') and coated with a high temperature resistant coating, mounted on a 6-axis robot is used to form a pyramid with a wall angle of 40° using a step down of 0.5 mm. First, no heating was applied. and a feed rate of 1500 mm/min was used. In a second test, a Nd:YAG 500 W laser torch, mounted on a 3-axis XYZ-table, was used as the heat source 4 to provide the heat flux to the sheet material at the opposite side of the forming side. The effective laser power was 300 W, a spot size of 7 mm and a feed rate of both the laser and the forming tool of 1125 mm/min were used. The forward offset between the center of the heating and the center of the forming tool was 2.4 mm, while the lateral offset was zero. FIG. 4 gives a top view of the forming surface. The movement of the 9 axes was controlled using a CNC controller 8. During the heated forming the temperature was kept constant at about 250° C. using a thermal sensor and power control. The average axial force on the tool for the cold formed pyramid is about 1550N, while the average axial force for the pyramid formed with heating is about 900N. FIG. 5 shows the comparison of both force measurement data.

Example 2

Figure 6:
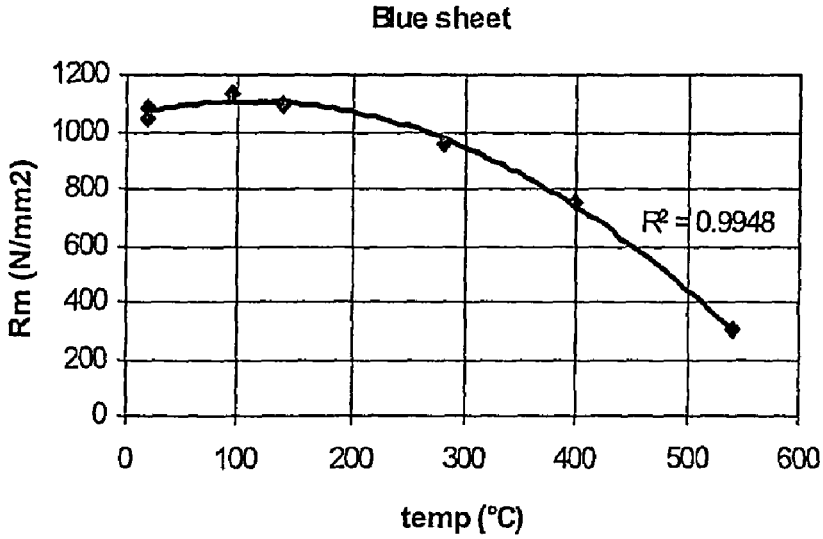

A sheet metal blank 1 of Din65Cr2 ('Blue sheet') of 0.5 mm thickness with Rockwell hardness of about 60 at room temperature and with ultimate tensile strength in function of temperature as shown in FIG. 6 has been used to compare a cold with a heated single point incremental forming test. For the forming a forming means 3 made of tungsten carbide ('grade Cki10'), coated with a high temperature resistant coating having a diameter of 10 mm and mounted on a 6-axes robot, CNC controlled, has been used to coldly form a conical shape with outer contour 160 mm, depth 40 mm and wall angle 57°. The step down size was 0.5 mm. For lubrication a graphite coating has been applied. The feedrate of the robot was set to 1500 mm/min. It was possible to make this part, whereas the part with wall angle 58° and the same settings as before cracked and thus failed. Therefore, with the settings, material and equipment as mentioned before, the conclusion is that for the cold forming the maximum obtainable wall angle for the single point incremental forming process is 57°

The same material, tools and robot have been used to make a heated sample. A Nd:YAG laser 500 W laser torch, mounted on a 3-axes XYZ table was used to heat the sheet material at the opposite side of the forming. The laser spot size was 9 mm. The offset between the center points of the forming and the heating tool was 3.5 mm, measured along the circular path of the forming tool and the laser. The feed rate of both the robot and the XYZ table was the same: 1500 mm/min, while the movement of both machines was controlled using a CNC controller 8. Graphite 33 was sprayed on both the sides of the sample: on the forming side for lubrication and on the heating side for laser absorption enhancement. The locoregional temperature during forming was measured using an infrared thermal camera with an uncooled microbolometer. The temperature during forming was kept constant at about 350° C. With the method described above, parts were made with a wall angle of 64° without any part failure, which amounts to an increase in wallangle of 7° between the non heated and the heated forming.

Example 3

A sheet metal blank 1 of Din65Cr2 ('Blue sheet') of 0.5 mm thickness with Rockwell hardness of about 60 at room temperature and with ultimate tensile strength in function of temperature as shown in FIG. 6 was used to compare a cold with a heated single point incremental forming test. For the forming a forming means 3 made of tungsten carbide ('grade Cki10'), coated with a high temperature resistant coating having a diameter of 10 mm and mounted on a 6-axes robot, CNC controlled, was used to coldly form a conical shape with outer contour 160 mm, depth 40 mm and wall angle 50°.

The step down size 0.5 mm. For lubrication a water-mixable high-performance cutting fluid based on a natural ester (vegetable ester based), known as Vasco 1000 was used. The feedrate of the robot was set to 1500 mm/min. The Din65Cr2 sample was clamped using a square backing plate that was at least 20 mm away from the slope change (i.e. the beginning of the cone). After forming, the sample stayed clamped, it was cleaned and it was analysed using a line scanning system (Metris laser probe type LC50).

After this, the same sample was made using locoregional heating. For the heating a Nd:YAG laser 500 W laser torch, mounted on a 3-axes XYZ table was used to heat the sample at the opposite side as the forming side. Cooling and lubrication was applied to the forming side by spraying a water-mixable high-performance cutting fluid (Vasco 1000). To obtain a non-cooled zone around the forming tool, the lubrication was blown away from the tool contact zone using pressurised air. By doing so a significant temperature gradient was ensured. The feedrate for the heated sample was 1125 mm/min. The temperature was kept constant at about 300° C. The effective laser power was kept constant at 375 W. The laser spot size was 9 mm. The lag between the center points of the forming and the heating tool was 3.5 mm, measured along the circular path of the forming tool and the laser. After forming, the sample remained clamped, it was cleaned and with the same equipment as for the cold cone it was analysed.

Figure 7:
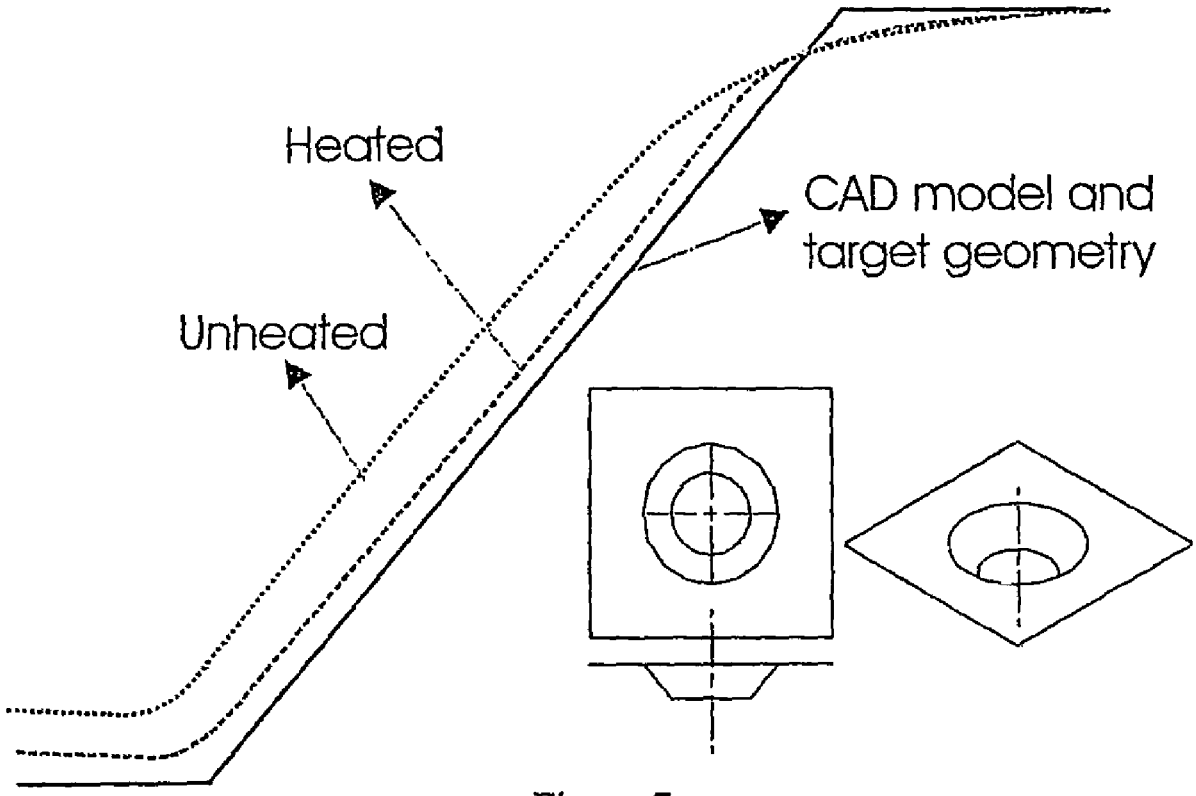

FIG. 7 shows a comparison of the coldly and warmly formed cone with the CAD model. It can be seen that the warmly formed cone shows a sharper transition from flat part to conical part. Along the slope of the cone, the warm cone is much closer to the CAD model than the cold cone. This is partially due to the reduced robot deformation when working with lower forces during warm forming and partially due to better control of the locally imposed forming on the sheet material.

In accordance with the purpose of the invention, as embodied and broadly described herein, the invention is broadly drawn to a method of incremental forming that has a dynamically moving heat flux to allow for a localised heating of the sheet and a tool to incrementally form the sheet blank. The dynamically moving heat flux can be from a moving heat means, for instance a moving heat source that emits radiant heat energy to the sheet material. In a particular embodiment moving reflectors direct the radiant heat energy emitted from a fixed heat source towards a selected zone of the sheet material.

The incremental forming apparatus can also be provided with a cooling means. The cooling means can be used to cool the sheet material to be formed at one side, for instance the opposite site of the contact point of the forming tool. Cooling of the sheet material can be by directing a cold flux, for instance a cooling fluid, in particular a cooled gas stream to the selected position on the sheet material. This can be through a hollow tube that directs the cooling fluid. The cooling means can be for example oil, pressurized air, nitrogen and conventional cooling fluids as used for milling operations. This cooling can help to provide a larger temperature gradient: warm at the contact zone and much cooler in the surrounding area where a higher yield strength is needed.

In a further embodiment the incremental apparatus comprises a lubricating means to apply a lubricant to or to make slippery or smoothen the contact zone on the sheet material of the forming means. Alternatively it is used to lubricate the outer impact end of the forming tool.

By the method of present invention the sheet material is in a controllable manner locally made more ductile or plastic, on the contact zone or in the vicinity of the contact zone of the forming means, by locoregionally providing a heat flux on the sheet material. Further away from the contact zone of the forming tool, the properties of the sheet material should not be changed, so this less formable part of the sheet material acts as a backing plate for the sheet material close to the forming tool. To optimise this effect an effective cooling means can be implemented to remove the heat from the sheet material when the forming tool is no longer in the vicinity.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description. It is to be understood that both the foregoing general description and the following detailed description are exemplary and explanatory only and are not restrictive of the invention, as claimed.

The method and apparatus of present invention is particularly suitable for sheet material forming in order to obtain highly accurate three-dimensional (3D) sculptured structures.

By utilising parametric programming, the method of the present invention can be used to readily generate one or more shaped geometries. In particular, parametric programming can be utilised to allow a user, such as a designer, engineer or computer numerically controlled (CNC) programmer, to vary the parameters of a particular task, such as determining the geometry of a specific sheet of material, which can be based upon the specific characteristics or parameters of the specific sheet or can be based on the capabilities of the forming tool 3, the heat at the heating means 4, the cooling means 6 or the required or desired performance criteria for the resulting formed sheet. Such characteristics may include, but are not limited to: the type of material of the sheet, the thickness, and the effect on the cost of the resulting formed sheet; and/or the performance criteria of the formed sheet.

In an embodiment of present invention the synchronisation of the toolpath of the forming means with the paths of the heating source is organised by a controller 8. It is clear that synchronisation of the heating means with the cooling means and with the forming tool of the sheet depends on the thermal diffusivity of the material to be formed: it takes some time for the heat wave to reach the forming zone. Depending on the material and the heating parameters, the correct forward offset can be chosen between the forming and the heating means. Furthermore, in some cases it might be needed to give the heating means also a lateral offset. It also might be needed to correlate the heating zone with the forming zone in terms of size.

In yet another embodiment of present invention the incremental forming apparatus comprises a cooling means. The correct cooling of the sheet can be of importance. While the sheet is being heated in the deformation zone, at the same time it can be cooled in the regions outside the deformation zone. This cooling will lower the need for a backing plate since the cooled sheet itself will be functioning as a kind of backing plate, because of its higher stiffness and yield strength. Because of the lower temperature in the cooled non-deformation zone, the yield stress is higher than in the zone under deformation, so in the latter zone plastic yielding will not be reached if the temperature is low enough. Materials that are hard to deform coldly, like carbon steel of high carbon content or Titanium alloys like Ti-6Al-4V, can be formed with the method described above.

Friction between the forming tool and the sheet material may induce heating on the contact zone. However since this heating is depending on the motion of the surface of the forming tool to the surface of the sheet material or (work piece), it is directly proportional to the heat generation by sliding friction. This heating is thus dependent on the speed and contact area or contact force of the forming tool. Moreover it is known in the art that high friction can deteriorate the surface quality of the forming tool or the sheet material. State of the art technologies try to reduce such sliding friction by decreasing the relative motion between the surface of the working tool and the sheet material (work piece) during forming, for instance by the hemispherical design of the impact end of the forming tool to achieve a rolling movement contact zone.

Present invention is to provide an energy input to the impact zone in a controllable manner and independent of the friction between the forming tool and the sheet material by a heat flux from a separate heating means.

The type of heating system used in present invention can vary and can be selected from different heating means, such as but not limited to electrical heating, heating by visible light and/or infrared light, laser heating, heating by a torch and induction current heating. The heating means may provide radiant heat energy for instance from a susceptor or a lamp. The present invention can also make use of a system to measure the temperature on the surface of the sheet material subjected to the temperature flux. In this regard, at least one temperature sensor, such as a pyrometer or infrared thermal camera, can be located near the front surface of the heated zone of the sheet material. The measured temperature can be used for real-time control of the radiation energy emitted from the individual heating means to achieve more accurate control of the temperature to induce plasticity.

In a particular embodiment of the Asymmetric Incremental Sheet Forming method of present invention the adjacent environment of the contact zone of the forming tool on sheet material is unheated. In yet another embodiment the adjacent environment of the contact points or of the contact zone of the forming tool on sheet material is subjected to a cooling process.

In yet another embodiment of the Incremental Sheet Forming method of present invention only an adjacent zone in front of the contact zone of the forming tool on its toolpath over the materials sheet is heated to make the material softer and to cause the material to need lower forces to deform in front of the contact zone. In some cases it is also beneficial to not only heat in front of the forming zone (forward offset), but also to heat with a lateral offset (see e.g. FIG. 4). This will enhance the creation of a clearly located slope change.

An advantage of providing locoregional heating of the sheet material is that the malleability and ductility of the material is locally increased and lower forces are required to deform that locus resulting in a decrease of unwanted or uncontrolled deformation. This result is more accurate formation of work pieces. An advantage of increasing the plasticity locally on the zone of contact of the forming tools or adjacent in front of the contact zone while maintaining the surrounding sheet material in a state of higher yield stress is that the surrounding operates as backing plate which results in limitation of unwanted deformations and better controllability in the manufacturing of accurate shaping of the work pieces.

The method and apparatus of present invention can be used to process materials that are less workable at room temperature such as brittle materials (e.g. magnesium) or materials of low malleability, rigid materials of high yield strength at room temperature (e.g. steels of high carbon content). But it can be used to process materials of various characteristics of hardness, ductility or malleability, tensile strength, density, and melting point.

For instance one embodiment of present invention is the use of the method and apparatus of present invention to form sheets of ultra-fine gram sizes or "nanostructured" polycrystalline metallic materials of increased toughness or strength of structural metals and alloys, and in particular to form sheets of nanostructured titanium metals and alloys.

In a particular embodiment of present invention the method and apparatus of present invention can be used to form sheets of metals with high tensile strength such as stainless steel, nickel steel, high carbon steel, molybdenum, or to form sheets of high-strength ductile materials such as HS steel, dual phase steel and TRIP steel.

The method and apparatus of present invention can also be suitable to form work pieces of metalloids and a variety of alloys such as brass, amalgams, aluminium, magnesium, Ti alloys and platinum.

The method and apparatus of present invention is particularly suitable to form work pieces of thermoplastics, e.g. polystyrene, polyethylene, polypropylene or polycarbonate.

Instead of a laser, any heat inducing device like (but not limited to) a hot-air blowout pipe or an induction device or a plasma beam can be used as the dynamically moving heat source.

Instead of a CNC controller to synchronize the heating and forming means with the sheet material, in a simpler system, the heating and forming means could for example be attached to a mechanical connection synchronizing their movement relative to the sheet to be formed. This mechanical connection always causes the heating means to run in front of the forming means, no matter what the direction of movement of the forming means would be.

Also any means to incrementally form the material in the locally heated zone can be used, like hammering, localised shot peening and hydrodynamic pressure.

LEGEND TO THE GRAPHICS OF THIS APPLICATION

Figure 1:
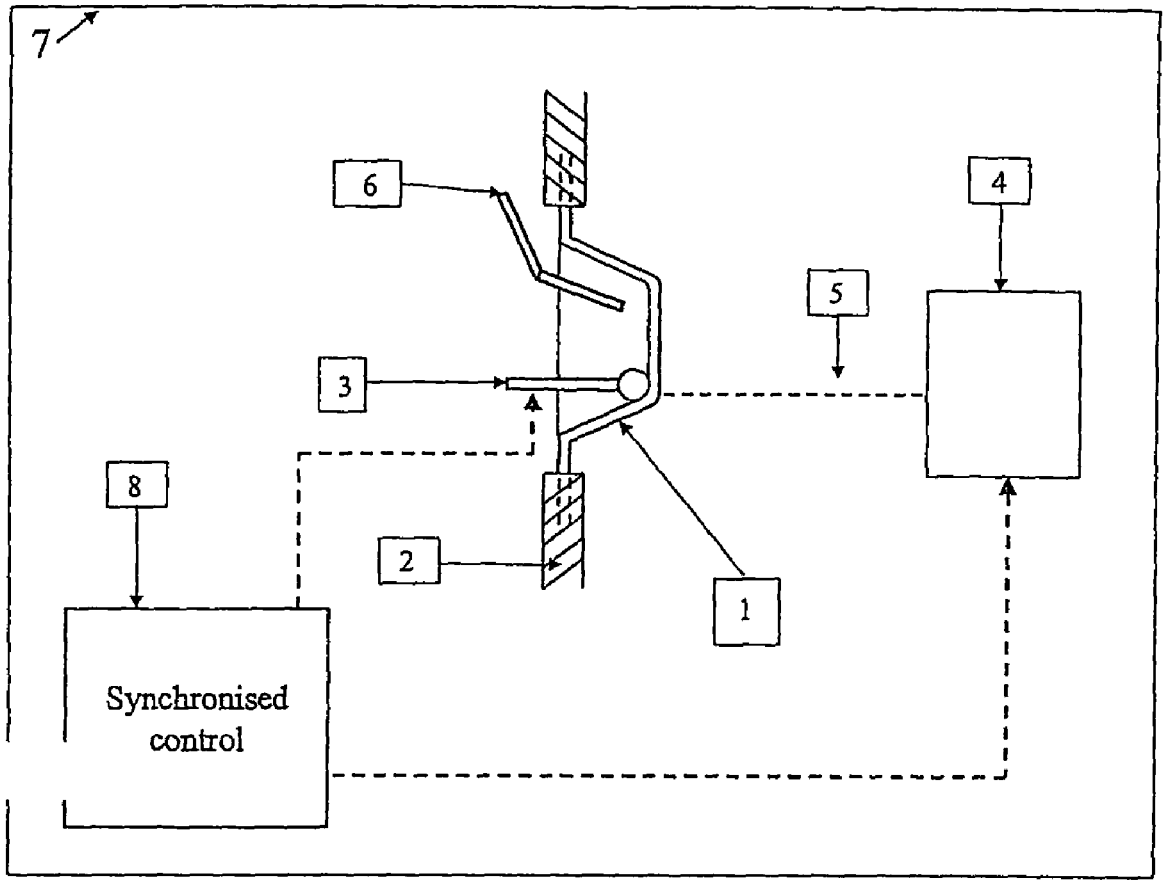
FIG. 1 shows how a sheet material (blank) 1 is clamped by a clamping system 2. A forming means or forming tool 3 to incrementally form the material is placed on one side of the clamping system 2. This forming tool 3 moves along programmed paths in order to form a certain desired shape. At the same time, a dynamically moving heat source or heating means 4 that is placed on the other side of the clamping system 2 locally heats the material by a heat flux 5 in the neighborhood of the forming tool 3. This heating locally lowers the yield strength and the hardening effect, thus causing a material that needs lower forces to deform. The locally heated and softened material is surrounded by cooler and thus material, characterized by a higher yield strength which eliminates/reduces the need for a backing plate. The cooler and higher yield strength material itself acts like a backing plate for the heated and thus more ductile work area of the incremental forming means. This makes it possible to manufacture work pieces with more pronounced features without the need for a support structure. The heat can be removed on the side of the forming means using a cooling means 6 which may also serve as lubrication source.

FIG. 1 is a side-view of the asymmetrical incremental forming apparatus providing a view on the process, whereby 1 is a sheet (blank), 2 is a clamping system, 3 is a means to incrementally deform the material, 4 is a dynamically moving heating means 4, 5 is the heat flux, 6 is a cooling means, 7 is an enclosing and 8 is the synchronisation of the toolpaths of the forming and the heating source with the sheet material.

Figure 2:
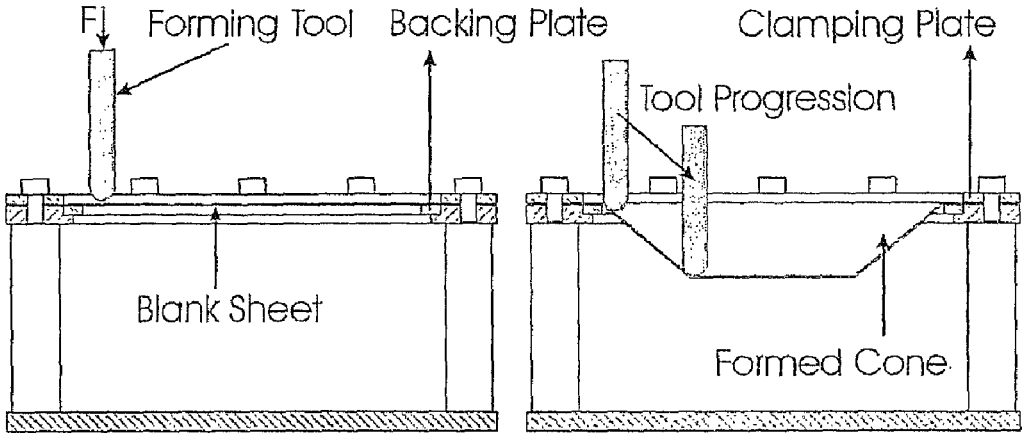
Figure 2 PRIOR ART

FIG. 2 provides a side view on a single point asymmetric incremental sheet forming apparatus.

Figure 3:
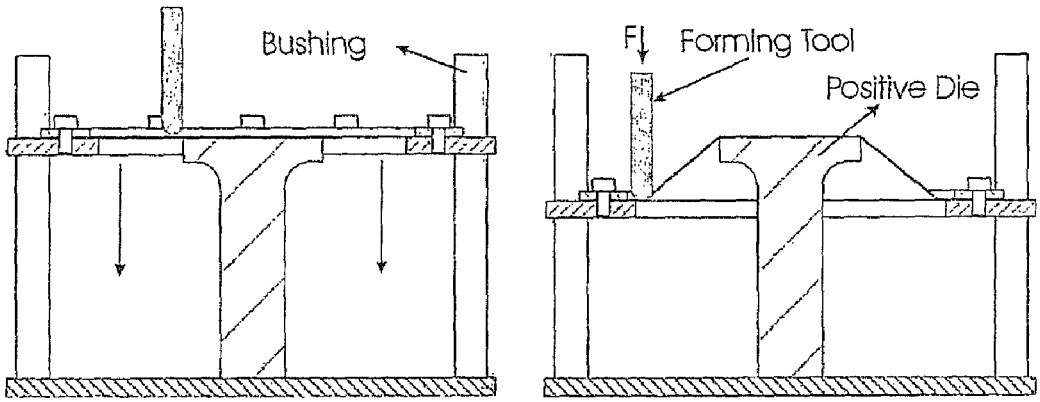
Figure 3 PRIOR ART

FIG. 3 provides a side view on a two point asymmetric incremental sheet forming apparatus.

FIG. 4 Isotherm plot of the forming zone with the settings as described in example 1. The grey circle is the heating zone by the laser, the bold circle stands for the tool contact zone. To show the meaning of 'lateral offset' it was chosen to show in this figure a lateral offset (dotted circle) between laser spot and tool contact zone of 1.5 mm, while in example 1 the lateral offset was zero.

FIG. 5 Comparison of axial force data of cold and heated single point incremental forming.

FIG. 6 Tensile strength of Din65Cr2 ('Blue Sheet') as a function of temperature.

FIG. 7 Sectional view of the accuracy comparison for a cone manufactured in Din65Cr2 ('blue sheet') of 0.5 mm thickness. The slope change of the locoregionally heated cone is closer to the CAD-model and a sharper edge is formed than the one of the coldly formed cone. Along the slope of the cone, the warm cone is much closer to the CAD model than the cold cone. This is partially due to the reduced robot deformation when working with lower forces during warm forming and partially due to better control of the locally imposed forming on the sheet material.

What is claimed is:

1. A sheet forming apparatus comprising at least one clamping system for holding a sheet material and at least one forming tool whereby the forming tool and the sheet material are movable relatively towards each other in three dimensions to plastically deform a contact zone that moves on the sheet material along at least one defined contact toolpath corresponding to a defined three dimensional shape of the sheet material to be formed, wherein the apparatus further comprises an asymmetric incremental sheet forming apparatus which comprises at least one heat source arranged to locoregionally provide a heat flux to the sheet material to form a moving heating zone and to increase the plasticity of the sheet material along the at least one contact toolpath of the forming tool, the incremental sheet forming apparatus further comprising at least one cooling means to cool a zone of sheet material adjacent to the contact zone of the forming tool or adjacent to the moving heating zone on the at least one contact toolpath.

2. The sheet forming apparatus of claim 1, wherein the at least one cooling means is located to provide a cold flux that dynamically follows the moving heating zone or the contact zone on the sheet material along the at least one contact toolpath of the forming tool.

3. The sheet forming apparatus of claim 1, wherein the at least one cooling means is adapted for cooling a zone of sheet material adjacent to the contact zone of the forming tool.

4. The sheet forming apparatus of claim 1, wherein the at least one cooling means is adapted for cooling a zone of sheet material surrounding the moving heating zone on the sheet material.

5. The sheet forming apparatus of claim 1, wherein the sheet has a first and second side and the cooling means is positioned to cool the sheet material at the first side of the contact zone of the forming tool on the sheet material and wherein the heat source is positioned to provide the heat flux at the second side of the sheet material opposite to the first side of the contact zone of the forming tool.

6. The sheet forming apparatus of claim 1, wherein the sheet has a first and second side, the heat source is positioned to heat the sheet material at the first side of the contact zone of the forming tool on the sheet material and wherein the cooling means is positioned to provide a cold flux at the second side of the sheet material opposite to the first side of the contact zone of the forming tool.

7. The sheet forming apparatus of claim 1, wherein the heat source is located to provide the heat flux that dynamically follows the moving contact zone on the at least one contact toolpath of the forming tool on sheet material.

8. The sheet forming apparatus of claim 1, wherein the heat source is arranged to locoregionally provide the heat flux to the sheet material and to increase the plasticity of the sheet material on the at least one contact toolpath of the forming tool at the zone of contact of the forming tool or slightly offset to the contact zone of the forming tool.

9. The sheet forming apparatus of claim 1, wherein the heat source is arranged to locoregionally provide the heat flux to the sheet material and to increase the plasticity of the sheet material on the at least one contact toolpath of the forming tool laterally offset to the contact zone of the forming tool.

10. The sheet forming apparatus of claim 1, wherein the heat source is arranged to locoregionally provide the heat flux to the sheet material and to increase the plasticity of the sheet material on the at least one contact toolpath of the forming tool forwardly offset to the contact zone of the forming tool.

11. The sheet forming apparatus of claim 1, wherein the clamping system is movable in three dimensions to move the sheet material according to pre-defined coordinates.

12. The sheet forming apparatus of claim 1, wherein the apparatus comprises the at least one heat source for heating the sheet material, a first control means for controlling the intensity of the heat flux from the movable heat source to the sheet material to be formed, a second control means for controlling the movement of the forming tool over its toolpath on the surface of said sheet material and a third control means for controlling the movement of the heat source or for positioning its heat flux on the sheet material and further comprising a synchronisation means for synchronising the movement of the heat source or its heat flux and the forming tool on the at least one contact toolpath to achieve if operational a locoregionally increase of the plasticity of the sheet material at the contact zone of the forming tool or slightly offset from this contact zone.

13. The sheet forming apparatus of claim 12, further comprising at least one pyrometer or another non-contact temperature measuring device over the sheet material, for measuring the temperature at the moving heating zone of the sheet material, said pyrometer connected to a fourth control means, wherein the first control means for controlling the intensity of the heat flux from the movable heat source to the sheet material controls locoregionally heating of said sheet material within a control temperature range having a lower limit defined as a temperature that does exceed a lowest temperature to locoregionally increase plasticity or lower the yield strength depending on constituent components of the material of the sheet to be formed, and an upper limit defined at a temperature that does not exceed a lowest heat decomposition initiation temperature or the melt point temperature of the material of the sheet.

14. The sheet forming apparatus of claim 12, wherein the second control means for controlling the movement of the forming tool over its at least one contact toolpath on the surface of said sheet material and the synchronisation means for controlling the movement of the heat source or for positioning its heat flux on the material sheet are integrated in the synchronisation controller to synchronise the at least one contact toolpath of the forming tool with the movement of the heat flux of the heat source.

15. The sheet forming apparatus of claim 1, wherein the movement of the forming tool and the moving heat zone from the heat source are synchronised by a computer control system.

16. The sheet forming apparatus of claim 12, wherein the synchronisation means comprises a computer numerically controlled (CNC) means to determine the geometry of a specific sheet of material by varying the parameters of the task based upon specific characteristics of the sheet material, on the capabilities of the forming tool, on the heat flux provided by the heat source, on the cold flux provided by the cooling means and/or on the required or desired performance criteria for the resulting formed sheet.

17. The sheet forming apparatus of claim 16, wherein the characteristics comprise parameters representing the material properties of the sheet material, the thickness of the sheet material, and performance criteria of the formed sheet.

18. The sheet forming apparatus of claim 1, further comprising a lubricating means to apply a lubricant to the sheet material at the contact zone of the forming tool with the sheet material.

19. The sheet forming apparatus of claim 1, further comprising a lubricating means to apply a lubricant at an outer contact end of the forming tool.

20. The sheet forming apparatus of claim 1, wherein the forming tool is a cast steel tool, glass tool, a ceramic tool, or a ceramic tool with a cemented carbide coating.

* * * * *